United States Patent [19]

Morris, Jr. et al.

[11] Patent Number: 5,055,091

[45] Date of Patent: Oct. 8, 1991

[54] WEAR STRIP FOR A CLAMP ATTACHMENT ON A LIFT TRUCK

[75] Inventors: Carl A. Morris, Jr., Sugarland; Kenneth R. Lane, Houston, both of Tex.

[73] Assignee: Long Reach Holdings, Inc., Houston, Tex.

[21] Appl. No.: 474,615

[22] Filed: Feb. 5, 1990

[51] Int. Cl.[5] ..... B66F 9/18

[52] U.S. Cl. ..... 414/621; 294/119.1; 384/42

[58] Field of Search ..... 414/607, 621, 667, 671; 384/26, 41, 42; 294/119.1

[56] References Cited

U.S. PATENT DOCUMENTS

| | | | |
|---|---|---|---|
| 3,245,562 | 4/1966 | Horton | 414/621 |
| 3,650,576 | 3/1972 | Hughes | 384/41 |
| 3,964,800 | 6/1976 | Grimes et al. | 384/42 |
| 3,965,814 | 6/1976 | Manko | 384/42 X |
| 4,185,944 | 1/1980 | Seaberg | 414/621 |
| 4,556,359 | 12/1985 | Sinclair | 414/621 |
| 4,642,020 | 2/1987 | Sinclair | 414/621 |
| 4,925,320 | 5/1990 | Foster et al. | 384/42 |

*Primary Examiner*—David A. Bucci

*Attorney, Agent, or Firm*—Fulbright & Jaworski

[57] ABSTRACT

A load bearing replaceable wear strip for use between the guides and slides in a clamp attachment for use on a lift truck. Each wear strip is C-shaped in cross section and is positioned in and matches the surfaces of each guide and extends substantially the entire length of the guide. The strip is telescopically movable in and out of the slide for replacement. A releasable retainer is connected between the wear strip and the guide.

3 Claims, 3 Drawing Sheets

WEAR STRIP FOR A CLAMP ATTACHMENT ON A LIFT TRUCK

BACKGROUND OF THE INVENTION

It is well known to provide bearings between the guides and movable slides of a clamp for a lift truck as disclosed in U.S. Pat. Nos. 3,245,562; 4,185,944; and 4,556,359. However, such bearings are partial bearings, designed for special uses, and require disassembly of the clamp for replacement of the bearings which increase the maintenance time and expenses.

The present invention is directed to a wear strip which provides a long life, abrasion resistant low bearing surface which extends substantially the full width of the clamp body. The wear strips are fully replaceable without removing the arms from the clamps and lubrication is not required.

SUMMARY

The present invention is directed to a load carrying clamp attachment for use on a lift truck having a body adapted to be mounted on a lift truck in which the body includes a plurality of elongate vertically spaced parallel guides. Each guide supports a longitudinally movable slide. First and second load clamps are connected to the slides for movement towards and away from each other for supporting and releasing a load. First and second piston and cylinder assemblies are connected to one of the load clamps for moving the clamps. The present improvement is directed to the use of a wear strip between each of the guides and its coacting slide. Each wear strip, which is C-shaped in cross section, is positioned in and matches the internal surface of each guide. The wear strip extends substantially the entire length of the guide for providing a long life abrasion resistant, full load bearing surface between each guide and slide. The strip is telescopically movable in and out of the slide for ease of replacement. A releasable retainer is connected between the wear strip and the guide for holding the wear strip in the guide, but allowing the wear strip to be replaced without removing the slide.

Another feature of the present invention is wherein the retainer is a threaded plug positioned adjacent the end of the guide for providing easy access thereto for insertion and removal. Preferably, the plug is inserted into the C-shaped cross section and threadably connected to the guide.

Yet a still further object of the present invention is wherein the wear strip includes at least two pieces spaced from each other for allowing thermal expansion, and a releasable retainer connecting between each of the end wear strips and the guide. In the preferred embodiment, the wear strip includes two end pieces and a middle piece therebetween and a releasable retainer is connected between each of the end pieces and the guide.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
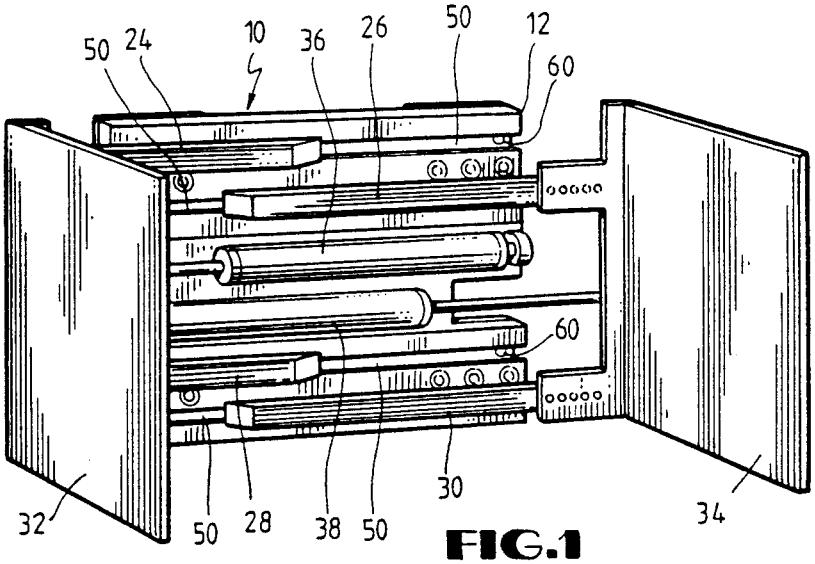
FIG. 1 is an elevational, perspective view of the clamp attachment of the present invention.

Referring now to the drawings, and particularly to FIGS. 1–4, the reference numeral 10 generally indicates the load carrying clamp attachment of the present invention which is adapted to be mounted on a lift truck for picking up, carrying, and releasing various types of loads. The attachment 10 includes a body 12 having mounting hooks 11 which are adapted to be carried from supports of a lift truck (not shown). The body 12 includes a plurality of elongate vertically spaced parallel guides, such as guides 16, 18, 20 and 22. Each of the guides supports a longitudinally movable slide. Thus, guides 16, 18, 20, and 22 support movable slides 24, 26, 28, and 30, respectively. First and second load clamps 32 and 34 are provided for gripping, carrying and releasing various types of loads, here shown as suitable clamps for gripping boxes, although other types of clamps may be used. The clamp 32 is connected to one or more slides such as slides 24 and 28, while load clamp 34 is connected to slides 26 and 30.

First and second piston and cylinder assemblies 36 and 38 are provided connected to the load clamps 32 and 34, respectively, for movement of the clamps 32 and 34 towards and away from each other. Preferably, the body 12 may include body extrusions 40 and 42, which are supported from straps 44. The extrusion 40, such as aluminum, contains the guides 16 and 18, and the extrusion 42 contains the guides 20 and 22.

The above general description of a load carrying clamp attachment for a lift truck is known. The present invention is directed to the provision of a wear strip 50 between each of the guides 16, 18, 20, and 22, and their coacting slides 24, 26, 28, and 30, respectively. The wear strips 50 are C-shaped in cross section for matching the configuration and internal surface of each of the guides and provide a long life, abrasion resistant, load bearing surface between each guide and its coacting slide. Preferably, the wear strips may be any suitable polymer wear strips, such as ultra-high molecular weight polyethylene. The wear strips 50 extend the entire length of the guides for providing complete protection for the extruded guides throughout the range of movement of the slides. The wear strips do not require lubrication and therefore provide a grease free environment.

In addition, the wear strips 50 are telescopically movable in and out of the slides 16, 18, 20, and 22, for ease of replacement, which can be done without disassembling the attachment 10, removing the clamps 32 and 34, or the guides 24, 26, 28, 30, from the body 12.

A releasable retainer 60 is connected between each wear strip 50 and its coacting guide for holding the wear strip 50 in the guide but allowing the wear strip to be replaced without removing the slide. Preferably, the retainers 60 are a threaded plug which may be inserted into the opening of the C-shaped cross section of the wear strip 50 and threadably connected to the guide. The plugs 60 preferably include a recess 62 in their face for receiving a non-circular tool, such as a square tool or Allenhead wrench, for removal and replacement. The retainers 60 are positioned adjacent the end of the guide whereby they may be easily uncovered by moving the clamp arms 30 and 32 inwardly for attachment and replacement.

Figure 5:
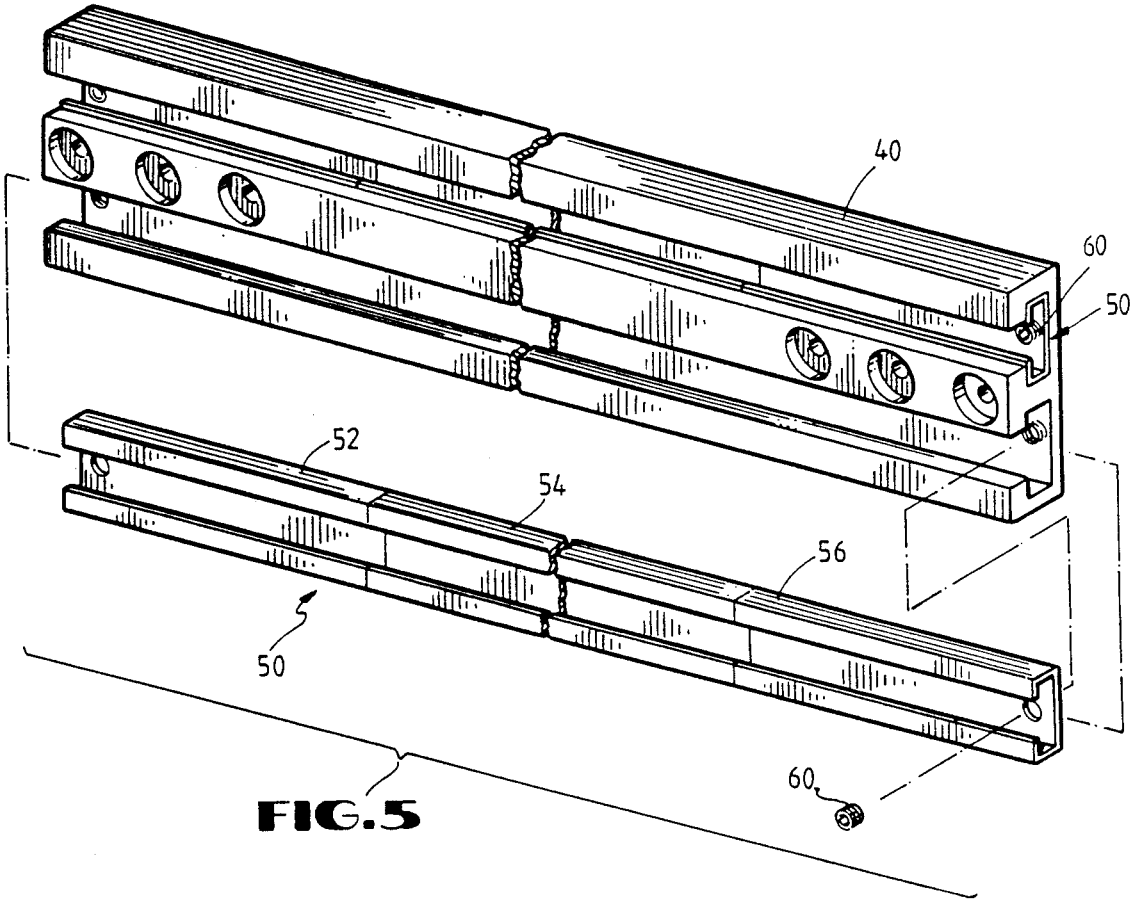
FIG. 5 is an enlarged exploded perspective elevational view, partly in cross section, illustrating a pair of guides along with the wear strips of the present invention.
Figure 2:
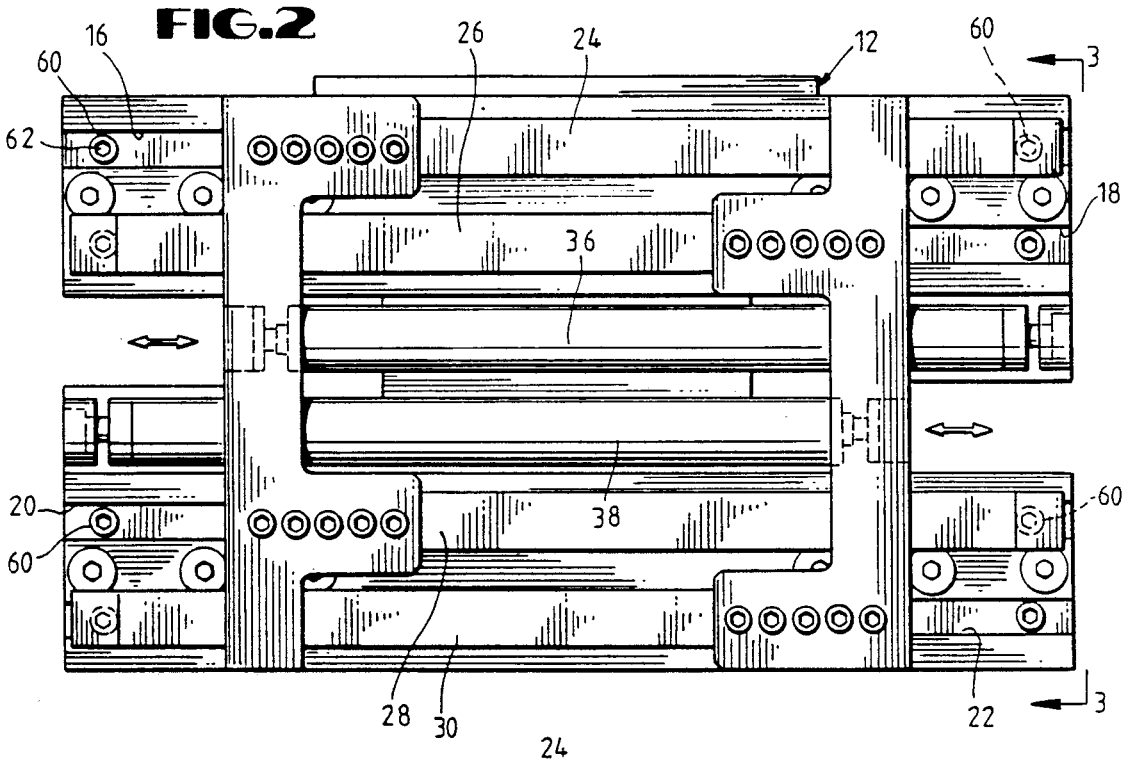
FIG. 2 is an enlarged elevational view of the present invention with the load clamps removed.
Figure 3:
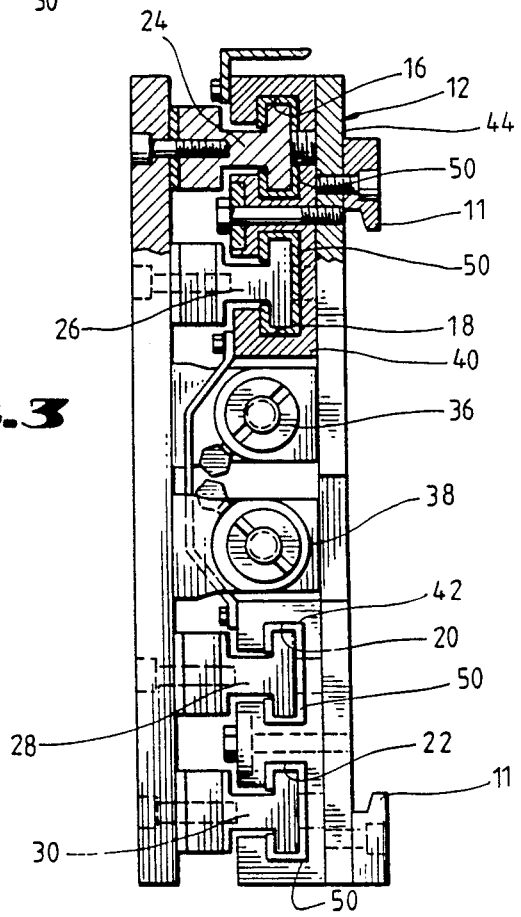
FIG. 3 is a view taken along the line 3—3 of FIG. 2 and partly in cross section.
Figure 4:
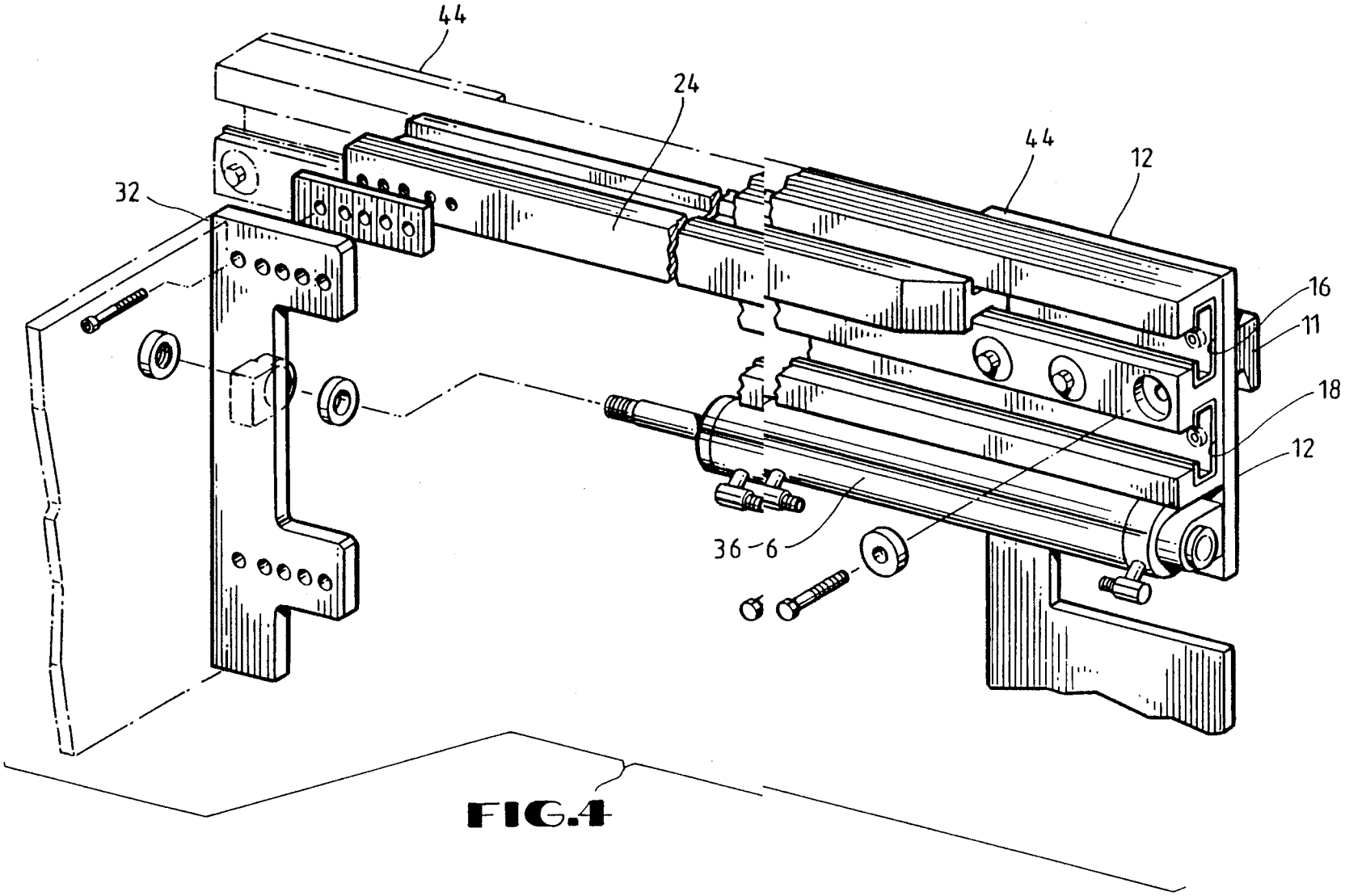
FIG. 4 is a fragmentary, exploded perspective elevational view of the present invention.

While the wear strip 60 may be a single integral wear strip retained in a guide by a single releasable retainer 60, the preferred embodiment, for manufacturing purposes, is as best seen in FIG. 5. Preferably, the wear strip 50 consists of end piece 52, middle piece 54, and a second end piece 56. The middle piece 54 is of a standard manufacturing length, and the end pieces 52 and 56 may, therefore, be cut to suitably fill out the remainder of the guide length. In the embodiment of FIG. 5, releasable retainer plugs 60 are connected between each of the end pieces 52 and 56 and the guide. Preferably, a space is provided between at least two of the pieces 52, 54 or 54 and 56 for allowing for thermal expansion of the wear strip.

Unlike all of the prior art clamps, the wear strips 50 are fully replaceable without disassembling the clamp or removing the clamps 32 and 34 and the slides 24, 26, 28, and 30. Instead, the clamp is moved inwardly into an inward position exposing the front of all of the plugs 60. After removing the plugs 60, a new wear strip 50 may be pushed in one side of each guide 16, 18, 20, and 22, while removing the old wear strip from the other end of the guide. The plugs are then replaced and the maintenance time and expense is greatly reduced.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be made without departing from the spirit of the invention and the scope of the appended claims.

What is claimed is:

1. In a load carrying clamp attachment for use on a lift truck having a body adapted to be mounted on a lift truck, said body having a plurality of elongate vertically spaced parallel guides, each guide supporting a longitudinally movable slide, first and second load clamps connected to said slides for movement toward and away from each other for supporting and releasing a load, and first and second piston and cylinder assemblies connected to one of the load clamps for moving said clamps, the improvement in wear strips between each of the guides and its coacting slides comprising, a plastic wear strip, C-shaped in cross section, positioned in and matching the internal surface of each guide and extending substantially the entire length of the guide, a vertical extension at each outer edge of the C-shape for fully enclosing the coacting contacting areas between the slides and guides, said strip being telescopically movable in and out of the slide, a releasable retainer connected between the wear strip and the guide for holding the wear strip in the guide, but allowing the wear strip to be replaced without removing the slide, said retainer is a threaded plug positioned adjacent an end of the guide, and the plug is inserted into a front of the C-shaped cross section and threadably connected to the guide.

2. The apparatus of claim 1 wherein the wear strip includes at least two pieces spaced from each other for allowing for thermal expansion, and a releasable retainer connected between each of the wear strips and the guide.

3. The apparatus of claim 1 wherein the wear strip includes two end pieces and a middle piece therebetween with a space between two adjacent pieces for allowing for thermal expansion, and a releasable retainer connected between each of the end pieces and the guide.

* * * * *